US008528450B2

(12) United States Patent
Lan et al.

(10) Patent No.: US 8,528,450 B2
(45) Date of Patent: Sep. 10, 2013

(54) AUXILIARY TOOL FOR ASSEMBLING AND DISASSEMBLING SPARK PLUG

(75) Inventors: Tzu-jung Lan, Kaohsiung (TW); Kuang-jung Lin, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 214 days.

(21) Appl. No.: 13/158,384

(22) Filed: Jun. 11, 2011

(65) Prior Publication Data

US 2011/0314974 A1 Dec. 29, 2011

(30) Foreign Application Priority Data

Jun. 24, 2010 (TW) ..... 99212067 U

(51) Int. Cl.
*B25B 23/08* (2006.01)
*B25G 1/02* (2006.01)

(52) U.S. Cl.
USPC ..... 81/177.6; 81/125

(58) Field of Classification Search
USPC ..... 81/13, 64, 177.6, 124.2, 124.3, 124.7, 81/125
See application file for complete search history.

(56) References Cited

U.S. PATENT DOCUMENTS

| | | | | |
|---|---|---|---|---|
| 2,511,049 | A * | 6/1950 | Coldwell | 81/448 |
| 3,680,159 | A * | 8/1972 | Wharram | 7/100 |
| 3,869,945 | A * | 3/1975 | Zerver | 81/125 |
| 5,074,173 | A * | 12/1991 | Cearley | 81/177.6 |
| 5,285,543 | A * | 2/1994 | Rowe | 7/138 |
| 5,313,860 | A * | 5/1994 | Liou | 81/437 |
| 5,455,997 | A * | 10/1995 | Nasiell | 29/456 |
| 5,572,913 | A * | 11/1996 | Nasiell | 81/177.6 |
| 5,732,606 | A * | 3/1998 | Chiang | 81/177.2 |
| 6,044,733 | A * | 4/2000 | Liu | 81/177.6 |
| 6,054,799 | A * | 4/2000 | Stefano | 313/118 |
| 6,813,975 | B2 * | 11/2004 | Kozak | 81/177.6 |
| 6,862,958 | B2 * | 3/2005 | Schade | 81/177.6 |
| 6,952,986 | B2 * | 10/2005 | Fu | 81/177.6 |
| 7,461,575 | B2 * | 12/2008 | Tribby | 81/177.8 |
| 7,571,668 | B1 * | 8/2009 | Chang | 81/57.29 |

FOREIGN PATENT DOCUMENTS

| | | |
|---|---|---|
| TW | M297291 | 9/2006 |

* cited by examiner

*Primary Examiner* — David B Thomas
(74) *Attorney, Agent, or Firm* — Cheng-Ju Chiang

(57) ABSTRACT

An auxiliary tool for assembling and disassembling a spark plug is used to assist the assembling and disassembling operation of the spark plug of a vehicle. The auxiliary tool comprises a spark plug sleeve, a flexible extender, and a rotating end portion. The spark plug sleeve is used to cover and rotate the spark plug. The flexible extender has flexibility and one end thereof is fixed on the spark plug sleeve. The rotating end portion is disposed on the other end of the flexible extender and detachably connected with a handle. In operation, the spark plug is firstly loosened by a conventional wrench, and the auxiliary tool then rotates the spark plug. The auxiliary tool is not limited by the limited engine space, so that the operational convenience of rotation operation can be increased and the operational time of assembling and disassembling the spark plug can be shortened.

8 Claims, 7 Drawing Sheets

AUXILIARY TOOL FOR ASSEMBLING AND DISASSEMBLING SPARK PLUG

FIELD OF THE INVENTION

The present invention relates to an auxiliary tool for assembling and disassembling a spark plug, and more particularly to an auxiliary tool for assembling and disassembling a spark plug which can increase the conveniences of rotation operation by a flexible extender.

BACKGROUND OF THE INVENTION

Nowadays, automobiles and motorcycles have become essential and convenient vehicles for daily life. Generally, the power source of the automobiles and the motorcycles is mainly an engine (i.e. internal combustion engine), wherein a spark plug used in the engine is one of the most important key components. When the spark plug malfunctions, the operation of the engine will be unstable, and even the engine can not work. Therefore, when repairing the engine of the automobile or motorcycle, it is a routine to assemble and disassemble the spark plug. For the reason, the manufacturer of the vehicles, such as automobiles and motorcycles, generally attach a assembling and disassembling tool of the spark plug when the vehicles is sold out, so that it is convenient for a driver to repair the spark plug, in order to keep the engine normally working.

However, there are some problems existing in the conventional assembling and disassembling tools of the spark plug. As shown in FIG. 1A, a perspective view of a conventional assembling and disassembling tool of a spark plug is illustrated. The conventional assembling and disassembling tool 90 is a hollow sleeve, wherein the lower end of the assembling and disassembling tool 90 has a socket part 91 which is formed with a polygonal inner space, and the upper end thereof has a rotating portion 92 which is formed with two pair of correspondingly through holes 921. When repairing a spark plug (not-shown), the socket portion 91 is used to cover on the spark plug, and then a turning rod 93 inserts into a pair of the through holes 921 of the rotating portion 92 to rotate the assembling and disassembling tool 90 by the turning rod 93, so as to assemble or disassemble the spark plug from the engine for carrying out the maintenance of the spark plug. Although the conventional assembling and disassembling tool 90 can achieve a purpose of assembling and disassembling the spark plug, the assembling and disassembling tool 90 is cylindrical and has a limited length. When there are other devices or equipments disposed around the spark plug (such as a cylinder head), the space for assembling and disassembling operation may be limited, and thus it causes that the above-mentioned assembling and disassembling tool 90 can not reach the top of the spark plug to smoothly cover the spark plug. Furthermore, it is also difficult for an operator to execute the assembling and disassembling operation to manually rotate the spark plug in the limited space.

In addition, Taiwan Utility Model Patent No. M297291 discloses an assembling and disassembling device for a spark plug of a vehicle, as shown in FIG. 1B. The assembling and disassembling device 80 comprises a sleeve 81, a turning rod 82 and a pin 83. The lower end of the sleeve 81 has a socket portion 811, and the upper end thereof is formed with a pair of engagement grooves 812 and a pair of through holes 813 disposed beside the engagement grooves 812. One end of the turning rod 82 is a turning portion 821, and the other end is a join portion 822 which has a join hole 823. The pin 83 inserts through the through holes 813 of the sleeve 81 and the join hole 823 of the turning rod 82. The main function of the pin 83 is to connect the turning rod 82 and the sleeve 81 in a vertical or straight manner. When the turning rod 82 and the sleeve 81 is vertical to each other, It can shorten the height of the assembling and disassembling device 80 which thus can be extended into a long and narrow space around a spark plug 71 of an engine 70 (as shown in a top view of FIG. 1C), so that the socket portion 811 of the sleeve 81 can smoothly cover the spark plug 71, and then it can loosen and disassemble the spark plug 71 by turning the turning rod 82.

However, although the above-mentioned assembling and disassembling device 80 solves the problem that it is difficult to insert into the engine 70 for rotation operation, there is a long and narrow space around the spark plug 71 of the engine 70. Thus, when using the assembling and disassembling device 80 to turn the spark plug 71. It will take a long time form beginning for loosing the spark plug 71, the operator only can manually rotate an extreme small angle once. As a result, it costs a lot of time to initially loosen the spark plug 71 to finally completely detach the spark plug 71 from the engine 70. As a result, it increases the time for rotation operation of assembling and disassembling the spark plug 71, and substantially lower the convenience of repairing the engine.

Therefore, it is necessary to provide an auxiliary tool for assembling and disassembling a spark plug to solve the problems existing in the conventional technology.

SUMMARY OF THE INVENTION

A primary object of the present invention is to provide an auxiliary tool for assembling and disassembling a spark plug, which has a flexible extender connected between a spark plug sleeve and a handle, so as to turn the spark plug by the handle on the outside of the engine. Because the rotation operation of the auxiliary tool can not be limited by the limited space of the engine and peripherals thereof, the operational convenience of rotation operation can be enhanced and the operation time of assembling and disassembling the spark plug can be shortened.

A secondary object of the present invention is to provide an auxiliary tool for assembling and disassembling a spark plug, which is provided with an elastic clamping block disposed in an inner top of the spark plug sleeve for elastically clamping a metal head or ceramic body of the spark plug. Thus, the spark plug can be temporarily fixed in the spark plug sleeve during assembling and disassembling the spark plug, so that it can increase the convenience of assembling and disassembling the spark plug.

A third object of the present invention is to provide an auxiliary tool for assembling and disassembling a spark plug, which has at least one guiding portion formed on an outer peripheral surface of the spark plug sleeve, so as to cooperate with a guiding member to cover the spark plug sleeve onto the spark plug, so that it can increase the convenience of assembling and disassembling the spark plug.

To achieve the above object, the present invention provides an auxiliary tool for assembling and disassembling a spark plug, which is used to assemble and disassemble a spark plug of a vehicle engine, characterized in that: the auxiliary tool comprises:

a spark plug sleeve used to cover the spark plug and rotate the spark plug;

a flexible extender having flexibility, wherein the flexible extender has an output end fixed on a top surface of the spark plug sleeve; and a rotating end portion disposed at the other end of the flexible extender opposite to the output end;

wherein an outer peripheral surface of the spark plug sleeve is provided with at least one guiding portion; the rotating end portion transfers a rotation force from the flexible extender to the spark plug sleeve, so as to indirectly turn the spark plug.

In one embodiment of the present invention, the output end of the flexible extender is formed with at least one rivet joint to fix on the top surface of the spark plug sleeve.

In one embodiment of the present invention, the auxiliary tool further comprises a handle, one end of the handle has an installation hole, and the installation hole is correspondingly engaged with the rotating end portion, so as to turn the rotating end portion.

In one embodiment of the present invention, an inner top portion of the spark plug sleeve further comprises an elastic clamping block, and a center of the elastic clamping block has an axial hole to elastically clamp a metal head of the spark plug.

In one embodiment of the present invention, an inner top portion of the spark plug sleeve comprises an elastic clamping block, and a center of the elastic clamping block has an axial hole to elastically clamp a ceramic body of the spark plug.

In one embodiment of the present invention, the outer peripheral surface of the elastic clamping block is provided with a groove, and an inner peripheral surface of the spark plug sleeve is provided with a flange corresponding to the groove.

In one embodiment of the present invention, the guiding portion is located between an open end of the spark plug sleeve and the flange of the inner peripheral surface of the spark plug sleeve.

In one embodiment of the present invention, the auxiliary tool further comprises a guiding member which guides the guiding portion by pushing or pulling.

In one embodiment of the present invention, the guiding portion is a through hole, a recess, or an annular groove.

In one embodiment of the present invention, the guiding member is a rod or a noose.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 2:
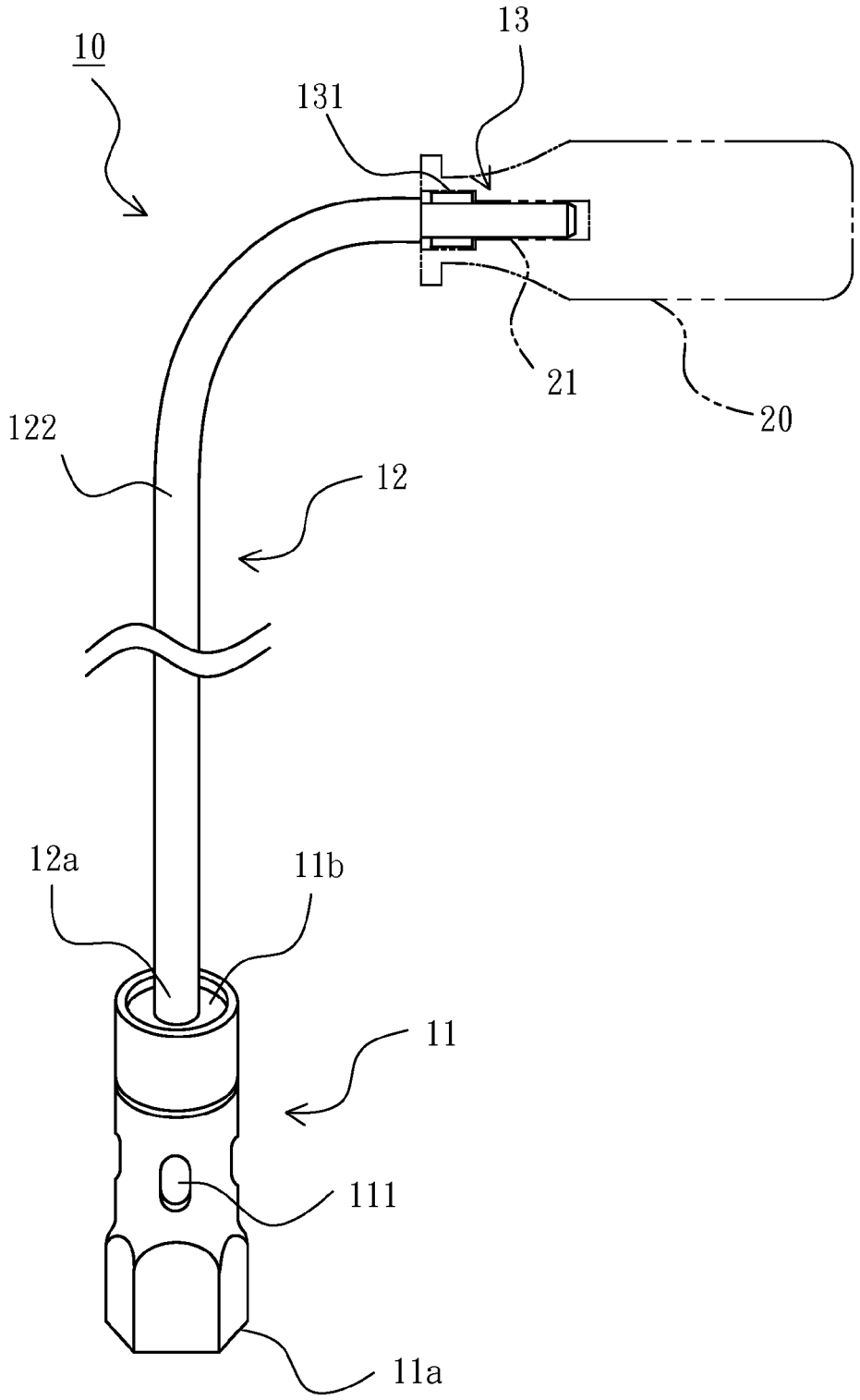
FIG. 2 is a perspective view showing an auxiliary tool for assembling and disassembling a spark plug according to a preferred embodiment of the present invention.

Referring now to FIGS. 2 to 5, a perspective view showing an auxiliary tool for assembling and disassembling spark plug according to a preferred embodiment of the present invention is illustrated in FIG. 2, wherein an auxiliary tool 10 for assembling and disassembling a spark plug is used to assist an assembling and disassembling operation of a spark plug 40 of a vehicle engine, and more particularly applied to an assembling and disassembling operation within a limited engine space around the spark plug 40. The auxiliary tool 10 comprises: a spark plug sleeve 11, a flexible extender 12 and a rotating end portion 13, wherein the auxiliary tool 10 can be used with a handle. The spark plug sleeve 11 is a hollow tube having an open end and provided with an open portion 11*a* and a top surface 11*b*, wherein the spark plug sleeve 11 is used to cover the spark plug 40 to turn/rotate the spark plug 40. The flexible extender 12 is a flexible rod body having flexibility, wherein the flexible extender 12 has an output end 12*a* mounted with the top surface 11*b* of the spark plug sleeve 11, and the other end thereof is mounted with the rotating end portion 13.

Figure 3A:
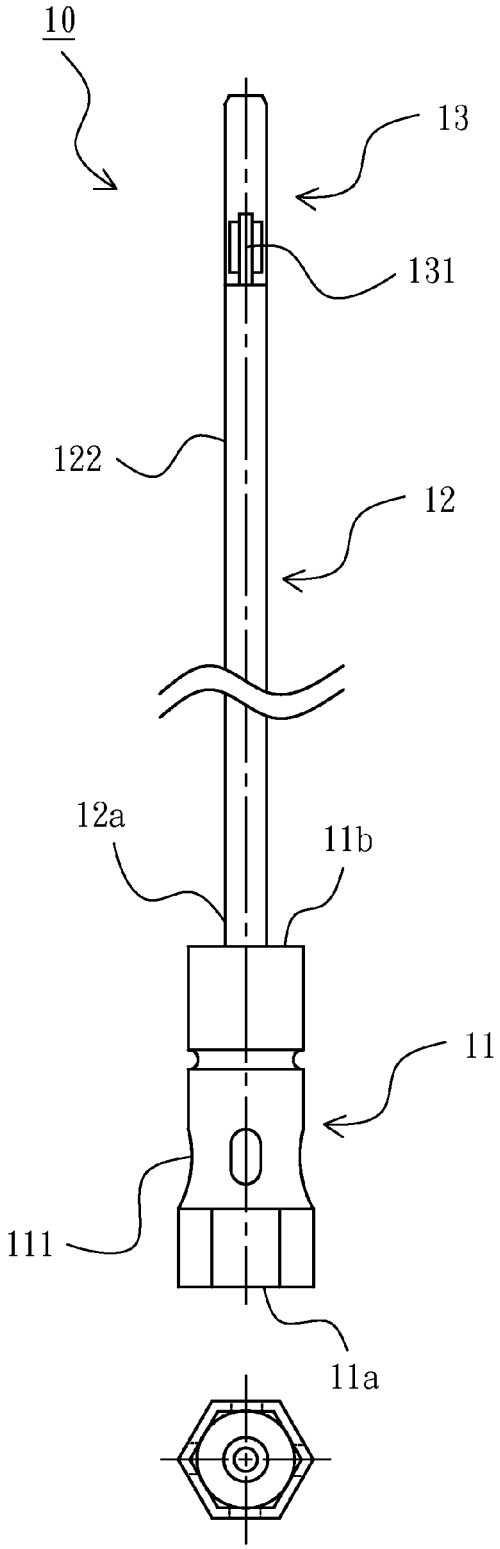
FIG. 3A is a side view and a bottom view showing an auxiliary tool for assembling and disassembling a spark plug according to the preferred embodiment of the present invention.
Figure 3B:
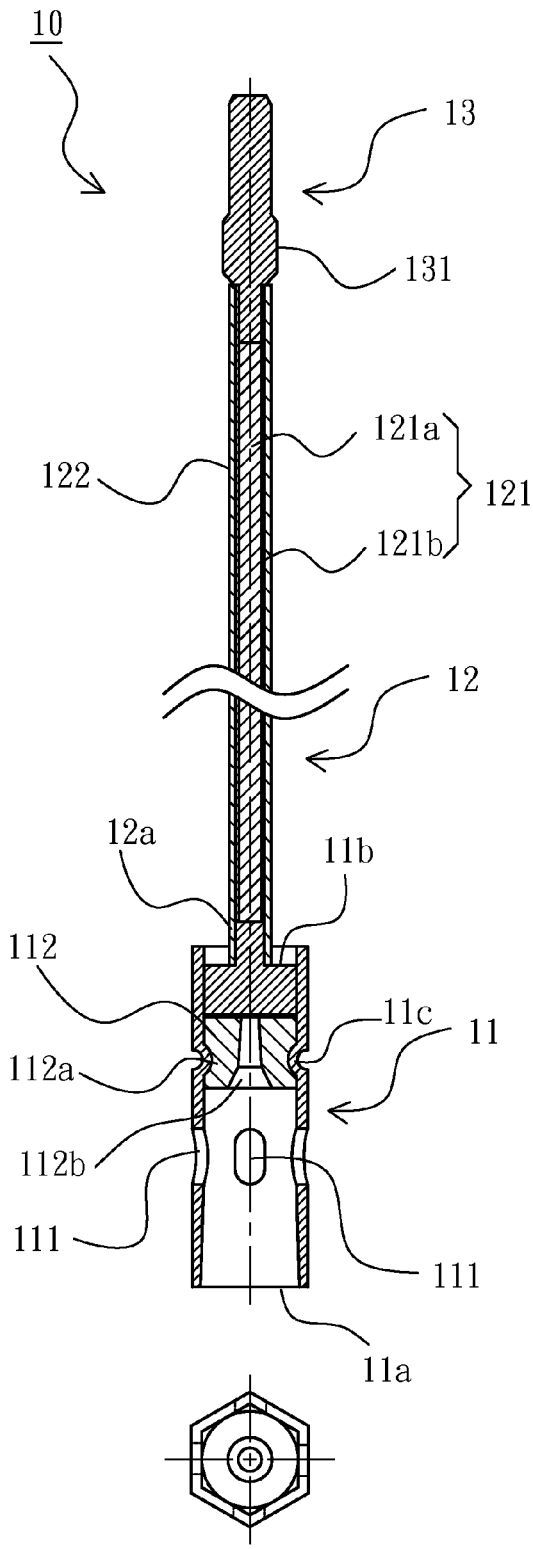
FIG. 3B is a cross-sectional view and a bottom view showing an auxiliary tool for assembling and disassembling a spark plug according to the preferred embodiment of the present invention.

Referring to FIGS. 3A and 3B, the construction of the auxiliary tool 10 is described more detailed, wherein FIG. 3A is a side view and a bottom view showing an auxiliary tool for assembling and disassembling a spark plug according to the preferred embodiment of the present invention; and FIG. 3B is a cross-sectional view and a bottom view showing the auxiliary tool for assembling and disassembling a spark plug according to the preferred embodiment of the present invention; For a need of illustration, FIGS. 3A and 3B have different view direction, FIG. 3B is a side view of FIG. 3A. Meanwhile, referring to the bottom view thereof to clarify there view directions.

As shown in FIGS. 3A, 3B, 4A, 4B and 5, the shape and size of the spark plug sleeve 11 corresponds with the to-be-covered spark plug 40. Generally, the spark plug 40 has a hexagonal turning portion 41 on an outer peripheral surface thereof, so that the spark plug sleeve 11 can cover the turning portion 41. Although the cross-section of the spark plug sleeve 11 of the auxiliary tool 10 according to present invention is a hexagonal hollow tube, the present invention is not limited thereto. The spark plug sleeve 11 also can be designed to any shape which can fit that of the spark plug 40, such as ring-spanner like or other polygonal shape.

In addition, the outer peripheral surface of the spark plug sleeve 11 is provided with at least one guiding hole 111, each of which can be a through hole or a recess. The guiding hole 111 is used to assist the spark plug sleeve 11 to cover the spark plug 40. An inner top portion of the spark plug sleeve 11 comprises an elastic clamping block 112. Preferably, the elastic clamping block 112 is made of rubber. An outer peripheral surface of the elastic clamping block 112 is provided with a groove 112*a*, and the inner top portion of the spark plug sleeve 11 is provided with a flange 11*c* corresponding to the groove 112*a*, wherein the flange 11*c* is engaged with the groove 112*a*, so as to fix the elastic clamping block 112 in the inner top portion of the spark plug sleeve 11. A center of the elastic clamping block 112 has an axial hole 112*b*, which is used to elastically clamp on a metal head or ceramic body of the spark plug 40, so that the spark plug 40 is clamped by the elastic clamping block 112 and positioned in the spark plug sleeve 11 without separation by accident. Operations of the spark plug sleeve 11 will be described more detailed hereinafter.

Furthermore, the flexible extender 12 preferably comprises a steel cable 121 therein and a hose 122 covering the steel cable 121, the steel cable 121 can be bent alone the axial direction thereof. In addition, the steel cable 121 preferably comprises an inner longitudinal steel cable 121*a* and an outer ring-like steel cable 121*b*. By combining the longitudinal steel cable 121*a* with the ring-like steel cable 121*b*, the steel cable 121 has better strength of the steel cable and better rotating performance of delivering a rotation force. Besides, one end of the flexible extender 12 preferably is formed at least one rivet joint by point riveting means for be fixed on one end of the spark plug sleeve 11. Thus, whatever the rotation direction of the steel cable 121 is, the flexible extender 12 can transfer the rotation force from the other end thereof to the spark plug sleeve 11 without losing rotation force, to prevent from separation of the spark plug 40 or consumption of the rotation force. The hose 122 is made of rubber or plastic, it is used to protect the longitudinal steel cable 121*a* and ring-like steel cable 121*b* of the steel cable 121.

Referring to FIGS. 3A and 3B, the rotating end portion 13 is formed on the other end of the flexible extender 12 opposite to the output end 12*a*. No matter what degree the flexible extender 12 is bent to, the rotating end portion 13 can be turned to indirectly rotate the spark plug sleeve 11 through the steel cable 121 of the flexible extender 12. Furthermore, the auxiliary tool 10 preferably uses with a handle 20 (as shown in FIG. 2). One end of the handle 20 has an installation hole 21. The installation hole 21 can correspondingly engage with the rotating end portion 13, so as to turn the rotating end portion 13 by the handle 20. The rotating end portion 13 according to the preferred embodiment of present invention cooperates with a type of handle 20 which has a structure capable of being shared with a combination type screwdriver (cabinet tip and Phillips head tip). The rotating end portion 13 is provided with at least two protrusions 131 on it's outer peripheral surface, the at least two protrusions 131 can be engaged into the installation hole 21 of the handle 20, so as to fix the rotating end portion 13 in the handle 20.

Figure 4A:
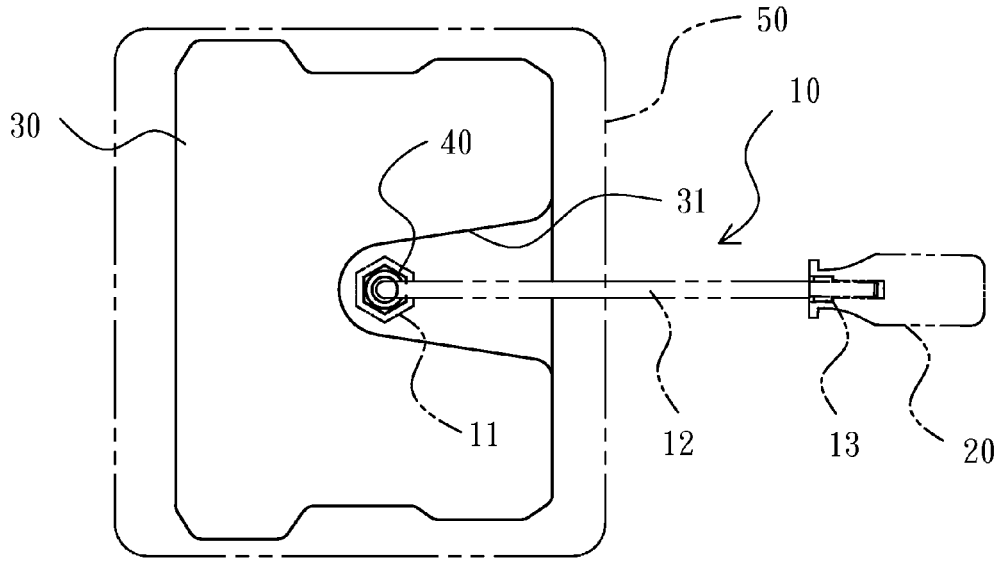
FIG. 4A is an operational top view of the tool for assembling and disassembling a spark plug according to the preferred embodiment of the present invention.
Figure 4B:
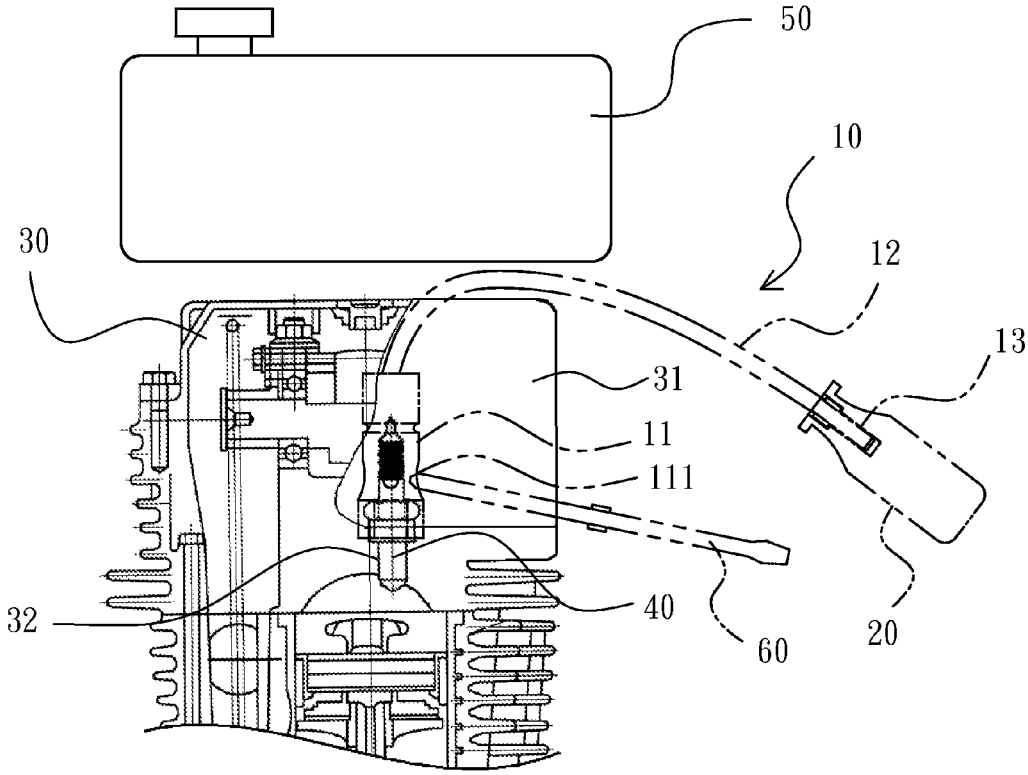
FIG. 4B is an operational side view of the tool for assembling and disassembling a spark plug according to the preferred embodiment of the present invention.
Figure 5:
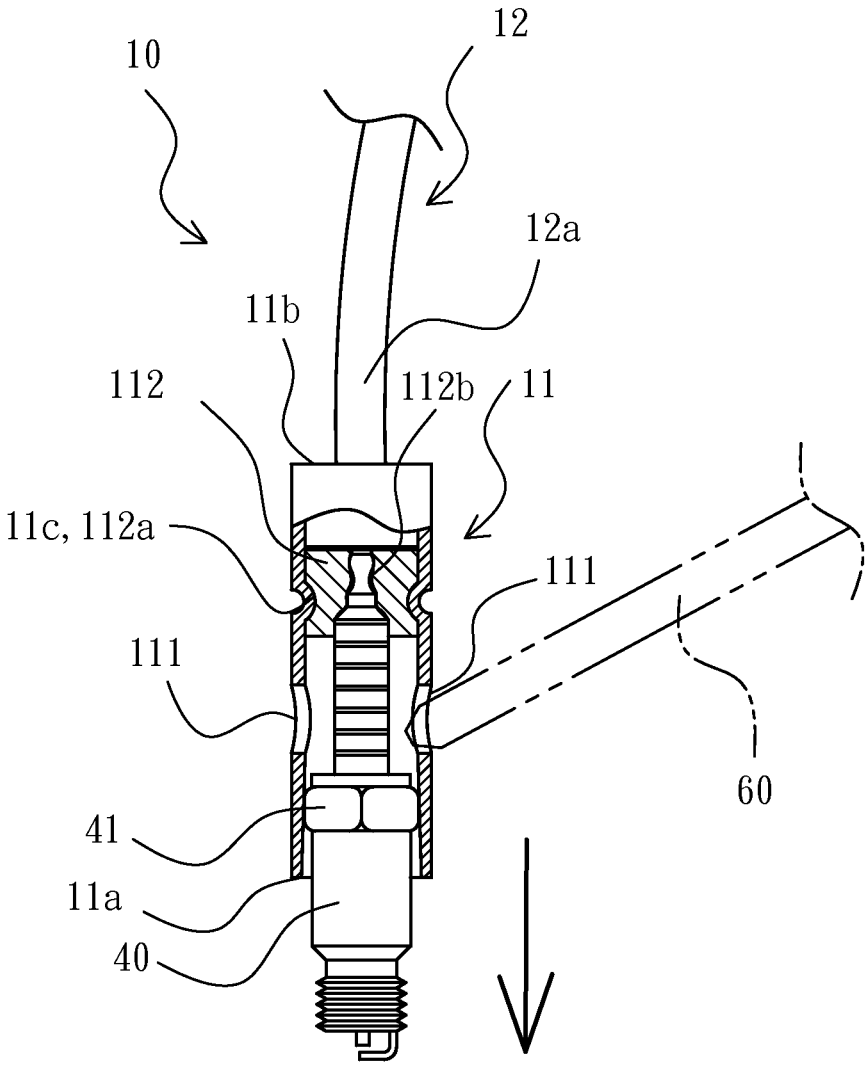
FIG. 5 is an operational cross-sectional view of the tool for assembling and disassembling a spark plug according to the preferred embodiment of the present invention.

Referring to FIGS. 4A, 4B and 5, the operation of the auxiliary tool 10 for assembling and disassembling a spark plug will be described more detailed, wherein FIG. 4A is an operational top view of the tool for assembling and disassembling a spark plug according to the preferred embodiment of the present invention; and FIG. 4B is an operational side view of the tool for assembling and disassembling a spark plug according to the preferred embodiment of the present invention. In addition, FIG. 5 is an operational cross-sectional view of the tool for assembling and disassembling a spark plug according to the preferred embodiment of the present invention.

As shown in FIGS. 4A and 4B, a configuration of a vehicle engine with a limited operational space is illustrated. A vehicle engine 30 is provided with at least one of the spark plug 40 thereon, the space surrounding the spark plug 40 is formed with a protrusion 31 formed by other parts of the vehicle engine 30, such as a radiator fins of a cylinder head, wherein the protrusion 31 looks like a "U" shape from a top view, and an oil tank 50 is disposed above the vehicle engine 30. The auxiliary tool 10 for assembling and disassembling a spark plug according to the preferred embodiment of the present invention is used to assist the assembling or disassembling operation of a spark plug 40 of the vehicle engine 30 of a vehicle (automobile or motorcycle).

Figure 1A:
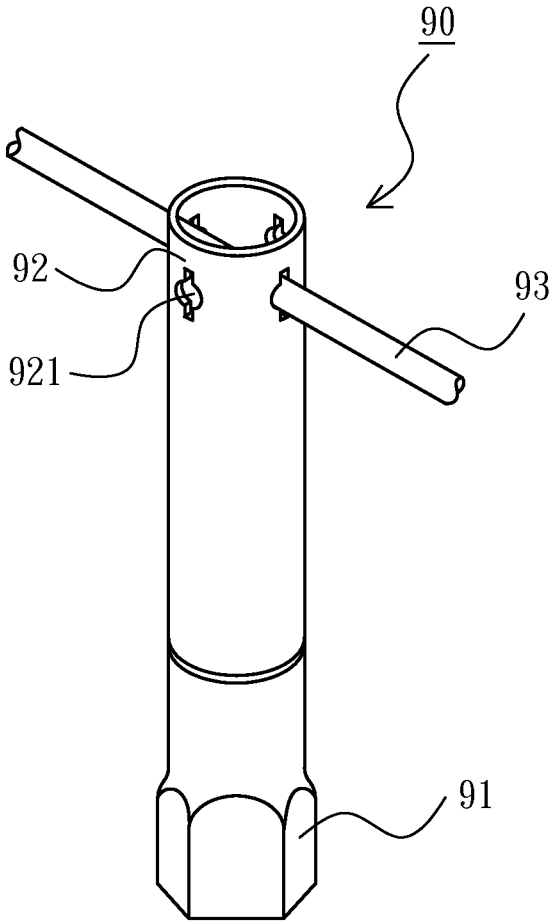
Fig. 1A PRIOR ART
FIG. 1A is a perspective view of a conventional tool for assembling and disassembling a spark plug.
Figure 1B:
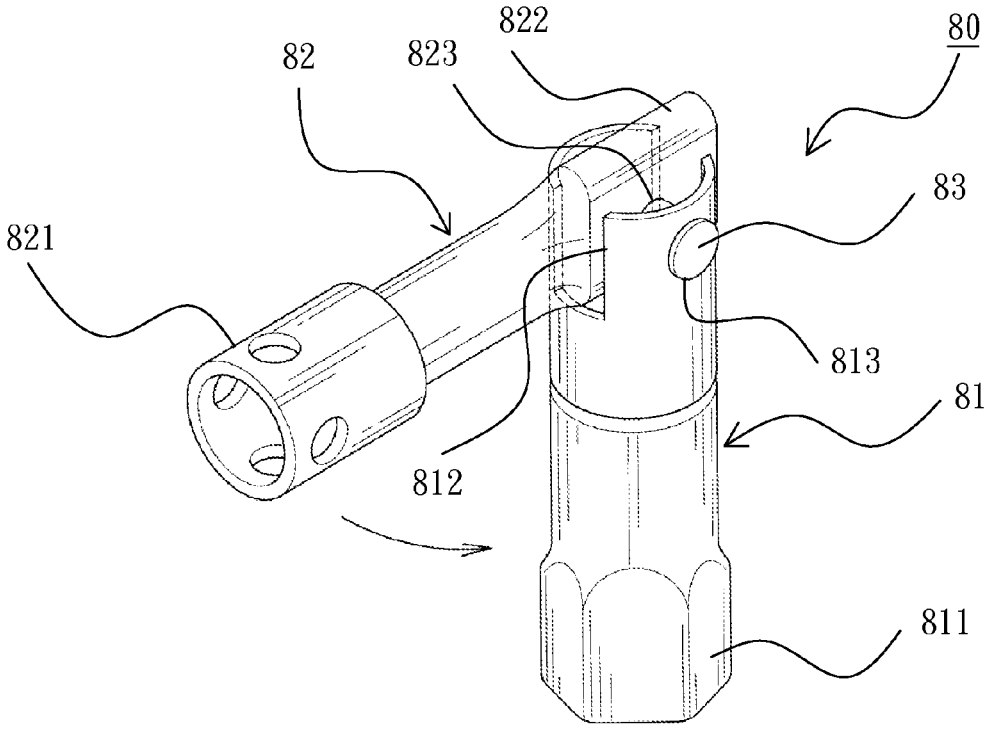
Fig. 1B PRIOR ART
FIG. 1B is a perspective view of another conventional tool for assembling and disassembling a spark plug.
Figure 1C:
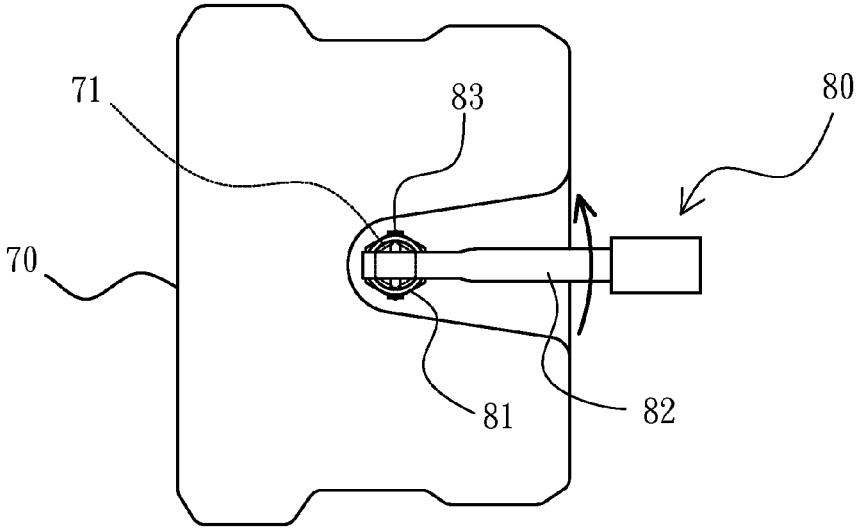
Fig. 1C PRIOR ART
FIG. 1C is an operational top view of the conventional tool for assembling and disassembling a spark plug in FIG. 1B.

As shown in FIGS. 4A, 4B, and 5, when executing a disassembling operation of the spark plug 40, steps of the disassembling operation are described, as follows: Firstly, pre-loosening the spark plug 40 by using a conventional wrench (as shown in FIG. 1B), and then removing the conventional wrench. Then, using the auxiliary tool 10 for assembling and disassembling a spark plug of the present invention, wherein a rod 60 (such as a rod of a combination type screwdriver) is used to insert into the guiding hole 111 of the spark plug sleeve 11 to push the spark plug sleeve 11 by inserting the rod 60 into the guiding hole 111, so as to guide the spark plug sleeve 11 to cover the top of the spark plug 40. Thus, the rod 60 and the guiding hole 111 can increase the operational convenience of covering the spark plug 40 at the initial stage of the disassembling operation. Referring to FIG. 5, the outer peripheral surface of an intermediate portion of the spark plug 40 has a turning portion 41, and the spark plug sleeve 11 has a hexagonal hollow tube having the open end, wherein the shape and size of the spark plug sleeve 11 corresponds to that of the spark plug 40. Thus, the spark plug sleeve 11 can sleeve on the turning portion 41 of the spark plug 40. The hole 112*b* of the elastic clamping block 112 disposed on the inner top portion of the spark plug sleeve 11 can elastically clamp the metal head (not-shown) of the spark plug 40. Meanwhile, the flexible extender 12 is bent outward to be curved.

Then, engaging the installation hole 21 of the handle 20 with the rotating end portion 13, and to manually turn the handle 20 outside the vehicle engine 30, so as to transfer the rotation force to the spark plug sleeve 11 and the spark plug 40 by the flexible extender 12 without losing the rotation force. That is, turning the handle 20 and the rotating end portion 13 by an external rotation force, so as to actuate the flexible extender 12 to axially turn by itself for thus driving the spark plug sleeve 11 to simultaneously turn. The pre-loosened spark plug 40 is indirectly turned until the spark plug 40 is wholly separated from a spark plug seat 32 of the vehicle engine 30. When the spark plug 40 is separated from the spark plug seat 32 of the vehicle engine 30, the spark plug 40 will be not separated from the spark plug sleeve 11 by accident because of the spark plug 40 is clamped by the elastic clamping block 112 of the spark plug sleeve 11. Thus, it can increase the operational convenience of disassembling operation of the spark plug 40 in the final disassembling stage.

On the other hand, when executing the assembling operation, the spark plug 40 is firstly inserted into the spark plug sleeve 11, and then the rod 60 is inserted into the guiding hole 111 of the spark plug sleeve 11, wherein the spark plug 40 fixed in the spark plug sleeve 11 is easy to be aligned with the spark plug seat 32 of the vehicle engine 30 with the help of the rod 60, so as to smoothly turn the spark plug 40 into the spark plug seat 32. Meanwhile, the flexible extender 12 is bent outward to be curved. Then, the handle 20 is correspondingly engaged with the rotating end portion 13, and the handle 20 outside the vehicle engine 30 is turned, so as to transfer the rotation force to the spark plug sleeve 11 and the spark plug 40 through the flexible extender 12 without losing the rotation force. Then, the spark plug 40 is indirectly turned into the spark plug seat 32 of the vehicle engine 30. Finally, the auxiliary tool 10 is removed, and the conventional socket wrench is used to turn the spark plug 40 to be tightly and stably positioned on the vehicle engine 30.

Figure 6:
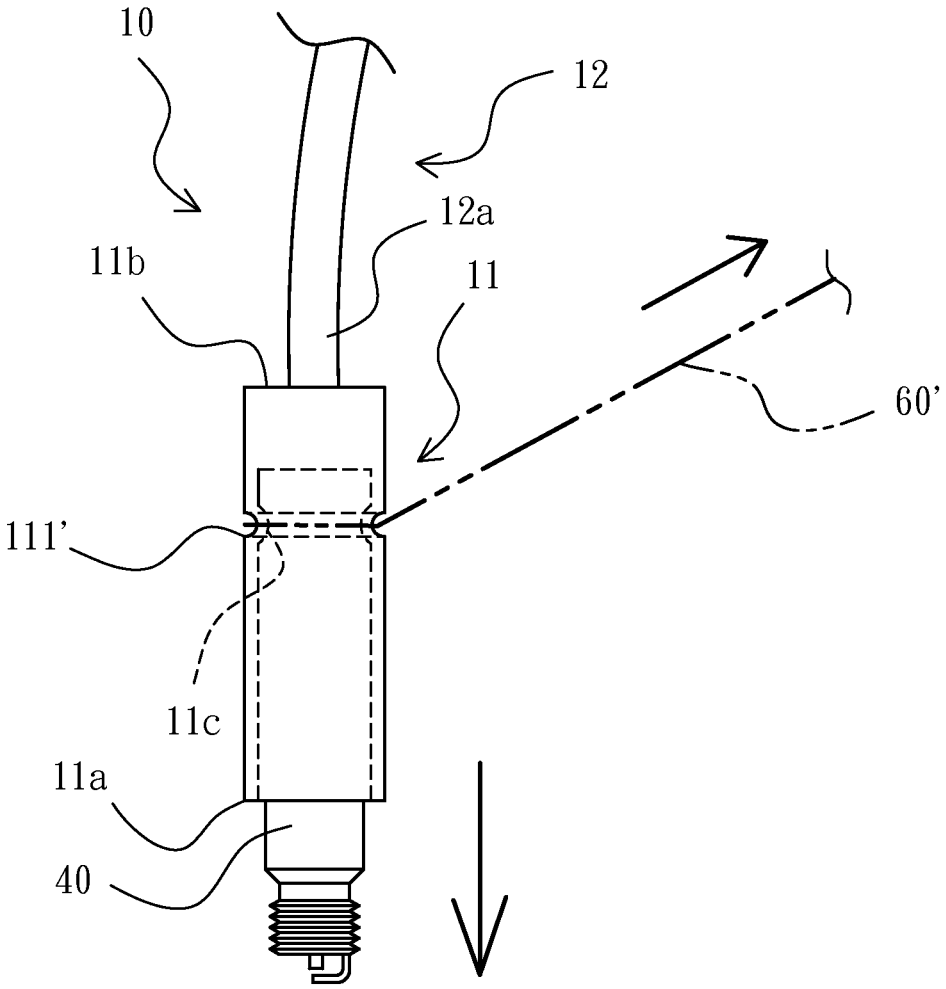
FIG. 6 is an operation schematic view of the tool for assembling and disassembling spark plug according to another preferred embodiment of the present invention.

Referring to FIG. 6, an operational view of the auxiliary tool for assembling and disassembling spark plug according to the other preferred embodiment of the present invention is disclosed. The embodiment in FIG. 6 is similar to the embodiment in FIG. 5, but the difference therebetween is that the embodiment in FIG. 6 has no guiding hole 111 (as shown in FIG. 5), but has an annular groove 111' which is formed on the outer peripheral surface of the spark plug sleeve 11 and defined by the flange 11*c* in the spark plug sleeve 11, so that the annular groove 111' can be used as at least one guiding portion. Meanwhile, a noose 60' is used as a guiding member, and the spark plug sleeve 11 can cover the spark plug 40 with the help of the noose 60'.

In the present invention, it is not limited by the form of the guiding portion and guiding member. Only if the cooperation of a guiding portion and a guiding member can provide the effect of guiding the spark plug sleeve 11 to cover the spark plug 40, the guiding portion and the guiding member can be used in the present invention. As shown in FIGS. 5 and 6, the guiding hole 111 or the groove 111' is one type of guiding portion; and the rod 60 or the noose 60' is one type of guiding member. It can guide the spark plug sleeve 11 to cover the spark plug 40 by the cooperation of the guiding portion and guiding member.

As described above, in comparison to the conventional tool for assembling and disassembling spark plug which is not easy to be extended into the limited space around the engine for rotation operation and thus wastes the time of assembling or disassembling the spark plug 40, the auxiliary tool 10 for assembling and disassembling a spark plug according to the present invention uses the flexible extender 12 to connect between the handle 20 and the spark plug sleeve 11, so as to turn the handle 20 outside the engine 30 to indirectly turn the spark plug 40. Because the rotation operation of the auxiliary tool 10 can not be limited by the limited engine space, the operational convenience of rotation operation can be effectively increased and the operational time of assembling and disassembling the spark plug 40 can be effectively shortened.

The present invention has been described with a preferred embodiment thereof and it is understood that many changes and modifications to the described embodiment can be carried out without departing from the scope and the spirit of the invention that is intended to be limited only by the appended claims.

What is claimed is:

1. An auxiliary tool for assembling and disassembling a spark plug, used to assemble or disassemble the spark plug of a vehicle engine, wherein the auxiliary tool comprises:

a spark plug sleeve used to cover the spark plug and rotate the spark plug;

a flexible extender having flexibility, wherein the flexible extender has an output end fixed on a top surface of the spark plug sleeve; and a rotating end portion disposed at the other end of the flexible extender opposite to the output end;

wherein an inner top portion of the spark plug sleeve further comprises an elastic clamping block, the outer peripheral surface of the elastic clamping block is provided with a groove, and an inner peripheral surface of the spark plug sleeve is provided with a flange corresponding to the groove; an outer peripheral surface of the spark plug sleeve is provided with at least one guiding portion, and the guiding portion is located between an open end of the spark plug sleeve and the flange of the inner peripheral surface of the spark plug sleeve; the rotating end portion transfer a rotation force from the flexible extender to the spark plug sleeve, so as to indirectly turn the spark plug.

2. The auxiliary tool for assembling and disassembling the spark plug according to claim 1, wherein the output end of the flexible extender is formed with at least one rivet joint to fix on the top surface of the spark plug sleeve.

3. The auxiliary tool for assembling and disassembling the spark plug according to claim 1, wherein the auxiliary tool further comprises a handle, one end of the handle has an installation hole, and the installation hole is correspondingly engaged with the rotating end portion, so as to turn the rotating end portion.

4. The auxiliary tool for assembling and disassembling the spark plug according to claim 1, wherein a center of the elastic clamping block has an axial hole to elastically clamp a metal head of the spark plug.

5. The auxiliary tool for assembling and disassembling the spark plug according to claim 1, wherein a center of the elastic clamping block has an axial hole to elastically clamp a ceramic body of the spark plug.

6. The auxiliary tool for assembling and disassembling the spark plug according to claim 1, wherein the auxiliary tool further comprises a guiding member which guides the guiding portion by pushing or pulling.

7. The auxiliary tool for assembling and disassembling the spark plug according to claim 6, wherein the guiding portion is a through hole, a recess, or an annular groove.

8. The auxiliary tool for assembling and disassembling the spark plug according to claim 6, wherein the guiding member is a rod or a noose.

* * * * *